US005468160A

United States Patent [19]

Broschard, III

[11] Patent Number: 5,468,160

[45] Date of Patent: Nov. 21, 1995

[54] MOUNTING BRACKET FOR AN ELECTRICAL CONNECTOR

[75] Inventor: John L. Broschard, III, Hershey, Pa.

[73] Assignee: The Whitaker Corporation, Wilmington, Del.

[21] Appl. No.: 291,229

[22] Filed: Aug. 16, 1994

[51] Int. Cl.[6] ..... H01R 13/73

[52] U.S. Cl. ..... 439/567

[58] Field of Search ..... 439/567, 571, 439/733, 741, 746–749

[56] References Cited

U.S. PATENT DOCUMENTS

| | | | |
|---|---|---|---|
| 4,074,929 | 2/1978 | Krider | 439/733 |
| 4,842,528 | 6/1989 | Krantz | 439/733 |
| 5,115,375 | 5/1992 | Garay | 361/400 |
| 5,184,963 | 2/1993 | Ishikawa | 439/79 |
| 5,213,515 | 5/1993 | Ishikawa et al. | 439/79 |
| 5,228,870 | 7/1993 | Gorenc et al. | 439/567 |
| 5,256,073 | 10/1993 | Reymond et al. | 439/733 |
| 5,288,247 | 2/1994 | Kaufman | 439/607 |
| 5,295,862 | 3/1994 | Mosquera | 439/567 |
| 5,297,966 | 3/1994 | Brennian, Jr. et al. | 439/64 |
| 5,308,251 | 5/1994 | Kaufman et al. | 439/64 |

FOREIGN PATENT DOCUMENTS 62-201581 12/1987 Japan .

*Primary Examiner*—Gary F. Paumen
*Attorney, Agent, or Firm*—Mary K. VanAtten

[57] ABSTRACT

An electrical connector having a mounting bracket to be inserted into a hold down recess and to secure the connector to a circuit board having a mounting hole. The bracket has a main body portion, a lower body portion, and a boardlock portion. The main body portion has wings extending therefrom and bent towards each other. The wings have tab sections extending straight up from the wings. The lower body portion has arms extending therefrom and bent towards each other. The wings and the arms form a compression fit with the recess when they are inserted therein. The tab sections are bent down to secure the bracket in the recess. The boardlock extends below the connector to be inserted into the mounting hole and secured therein.

14 Claims, 4 Drawing Sheets

MOUNTING BRACKET FOR AN ELECTRICAL CONNECTOR

FIELD OF THE INVENTION

The invention relates to a bracket for securing a connector to a circuit board, or alternatively, for securing stacked connectors to a circuit board.

BACKGROUND OF THE INVENTION

There are numerous ways of securing an electrical connector to a circuit board. For example, the connector may be provided with mounting ears having bores for accepting threaded mounting bolts which extend through corresponding apertures of the circuit board and are secured by nuts on the opposite side of the board. Connectors have also been known to be mounted and secured to circuit boards by way of mounting brackets. U.S. Pat. No. 5,297,966 discloses brackets for securing a connector to a circuit board Co-pending application Ser. No. 08/235,617 discloses the use of a screw to secure stacked connectors to a circuit board It would be desirable to have a mounting bracket that can take the place of the screw and secure a connector to a circuit board, or alternatively, secure stacked connectors to a circuit board.

U.S. Pat. Nos. 5,184,963 and 5,213,515 disclose top loaded board locks which are inserted into flanges or other areas of the housing from the surface opposite the board mounting face of the connector. When mounting such connectors to circuit boards, it is necessary to use a tool to apply force directly to the board lock members to insert them into the circuit board apertures so that the board lock devices will not move backwardly out of the connector housing in response to resistance to insertion into the circuit board apertures. It is desirable, therefore, to have a board lock member that is self-retaining in the housing and does not require use of a special insertion tool.

SUMMARY OF THE INVENTION

According to the invention, a mounting bracket, for securing a connector to a circuit board by way of a hold down recess on the connector and a mounting hole on the circuit board, is comprised of a main body portion, a lower body portion, and a boardlock portion. The main body portion has wings bent towards each other which form a compression fit when inserted in the hold down recess. The wings have tabs which can be bent down to secure the bracket in the recess. The lower body portion has arms bent towards each other which form a compression fit when inserted in the recess. The boardlock is adapted to be received in a mounting hole on the circuit board to secure the connector to the circuit board.

BRIEF DESCRIPTION OF THE DRAWINGS

Embodiments of the invention will now be described by way of example with reference to the accompanying drawings, in which.

DETAILED DESCRIPTION OF THE INVENTION

Figure 1:
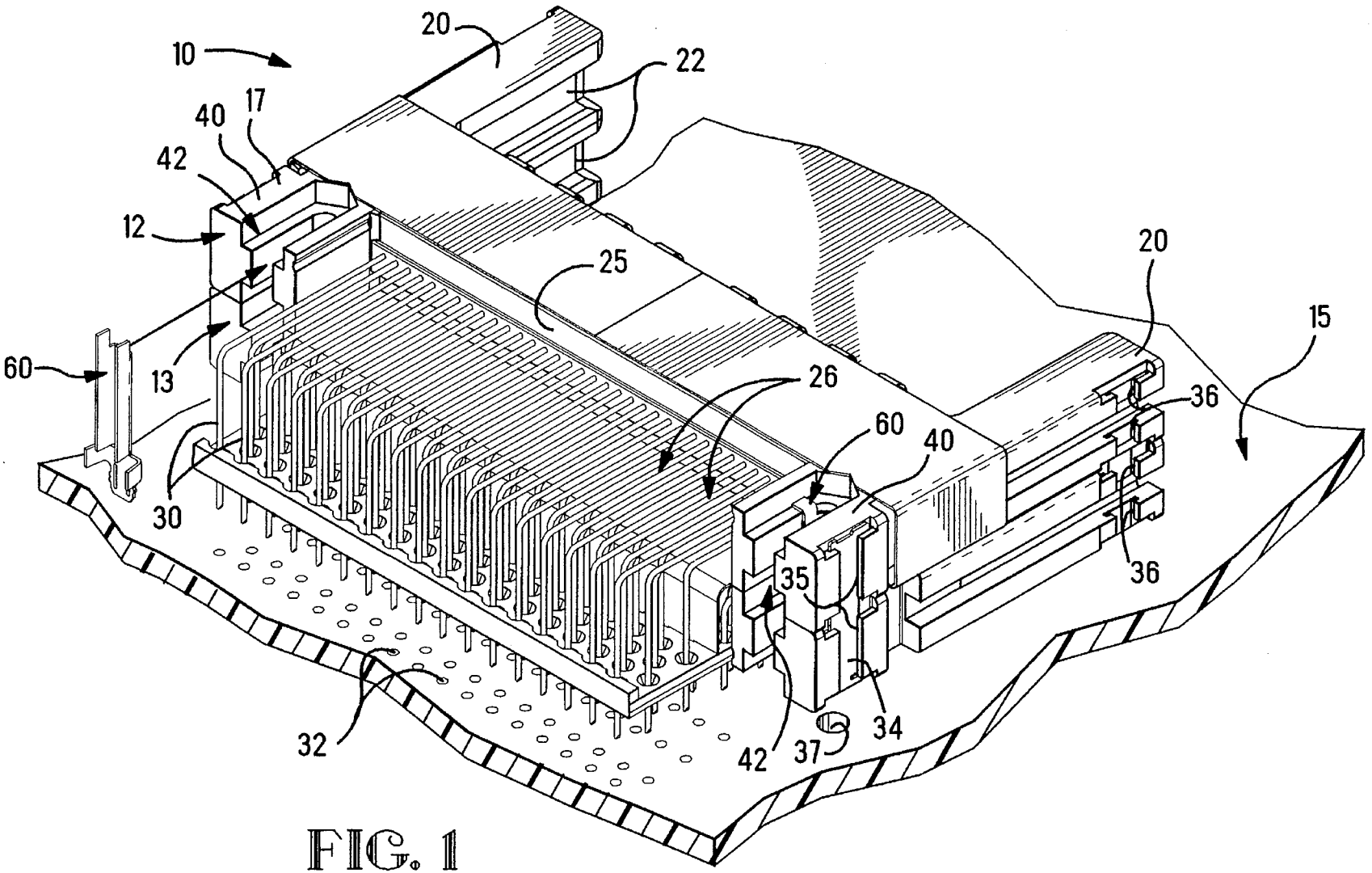
FIG. 1 is a perspective view of a connector, a mounting bracket and a circuit board exploded therefrom.
Figure 2:
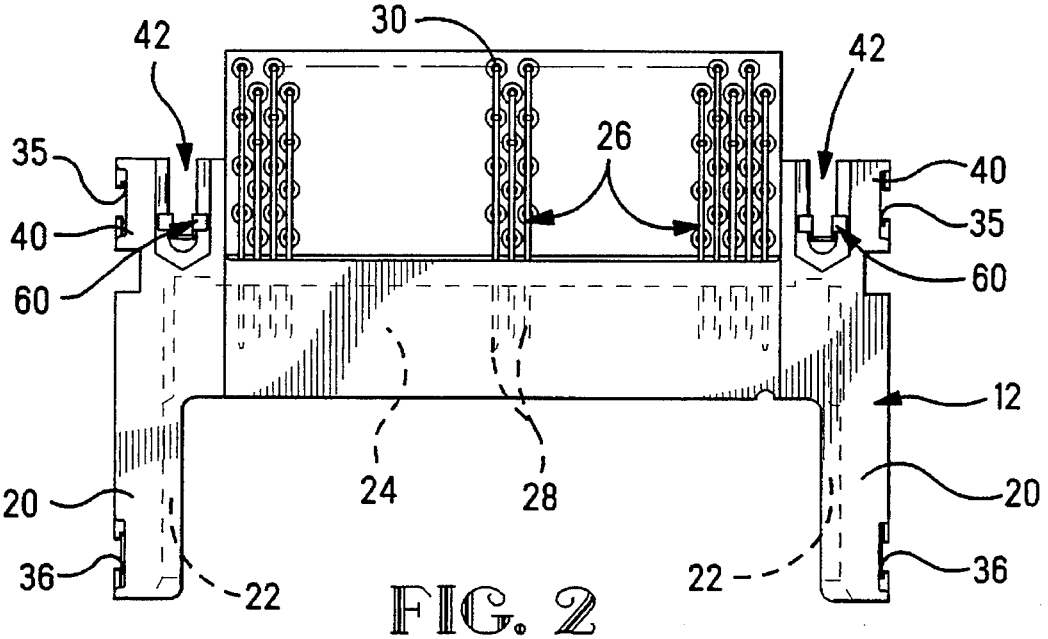
FIG. 2 is a top plan view of the connector.
Figure 3:
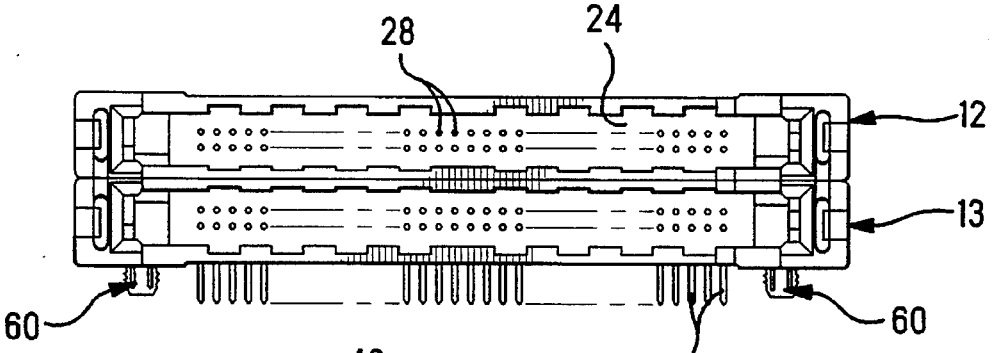
FIG. 3 is a front plan view of the connector.

FIGS. 1 and 2 show a connector array 10 as is disclosed and described in greater detail in co-pending application Ser. No. 08/235,617. The connector array 10 is for mounting two card connectors 12, 13, stacked on top of each other, to a circuit board 15. The upper connector 12 and the lower connector 13 each include an insulating housing 17 having side arms 20. The side arms 20 have guide slots 22 for guiding a card (not shown) into the connector 12, 13. Each connector 12, 13 has a card receiving channel 24 for receiving the card therein. The housing 17 has contacts 26 disposed therein. The contacts 26 have contact portions 28, see FIG. 2, disposed along the card receiving channel 24 for electrical connection to the card. The contacts 26 have outwardly and downwardly extending tail sections 30 disposed along rear faces 25 of the connectors 12, 13 for electrical connection to the circuit board 15. The circuit board 15 has holes 32 for receiving the tail sections 30.

The connectors 12, 13 have securing arms 40 on either side and extending from the housing 17 in the opposite direction as the side arms 20. The securing arms 40 have U-shaped hold down recesses 42 with an inner wall 43 extending along the U-shape of the recess 42. The recesses 42 on the connectors 12,13 are in alignment when the connectors 12, 13 are stacked on top of each other and are alike in construction. The recesses 42 have protrusions 44 extending completely along the U-shaped recesses 42, see FIGS. 5 and 6. The protrusions 44 have walls 49 which are located in the recess, upper shoulders 46 which define the top of the protrusions 44 and lower shoulders 47 which define the bottom of the protrusions 44.

The connector array 10 has a shroud 33 for shielding the connector as is disclosed in Ser. No. 08/235,617. The connector array 10 further has a clip 34 which is used to secure the connectors 12, 13 together. The clip can be disposed in rearward aligning slots 35 as shown, or alternatively, the clip 34 can be disposed in forward aligning slots 36.

Figure 4:
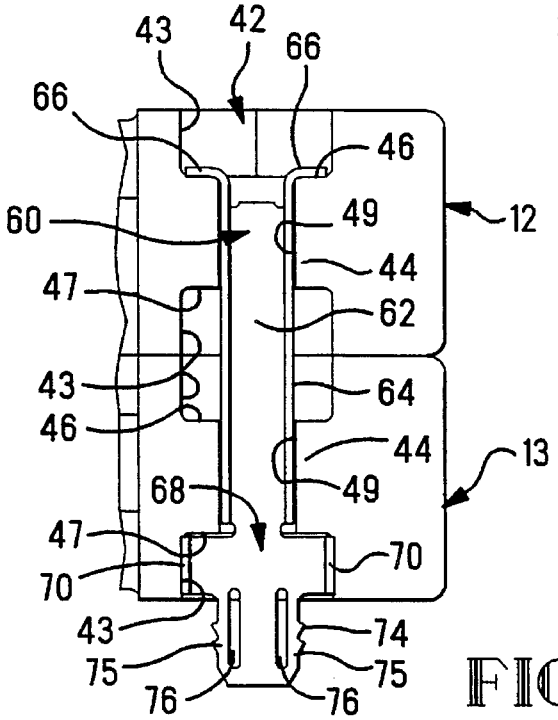
FIG. 4 is a rear view of the hold down recess with the mounting bracket in place therein.
Figure 5:
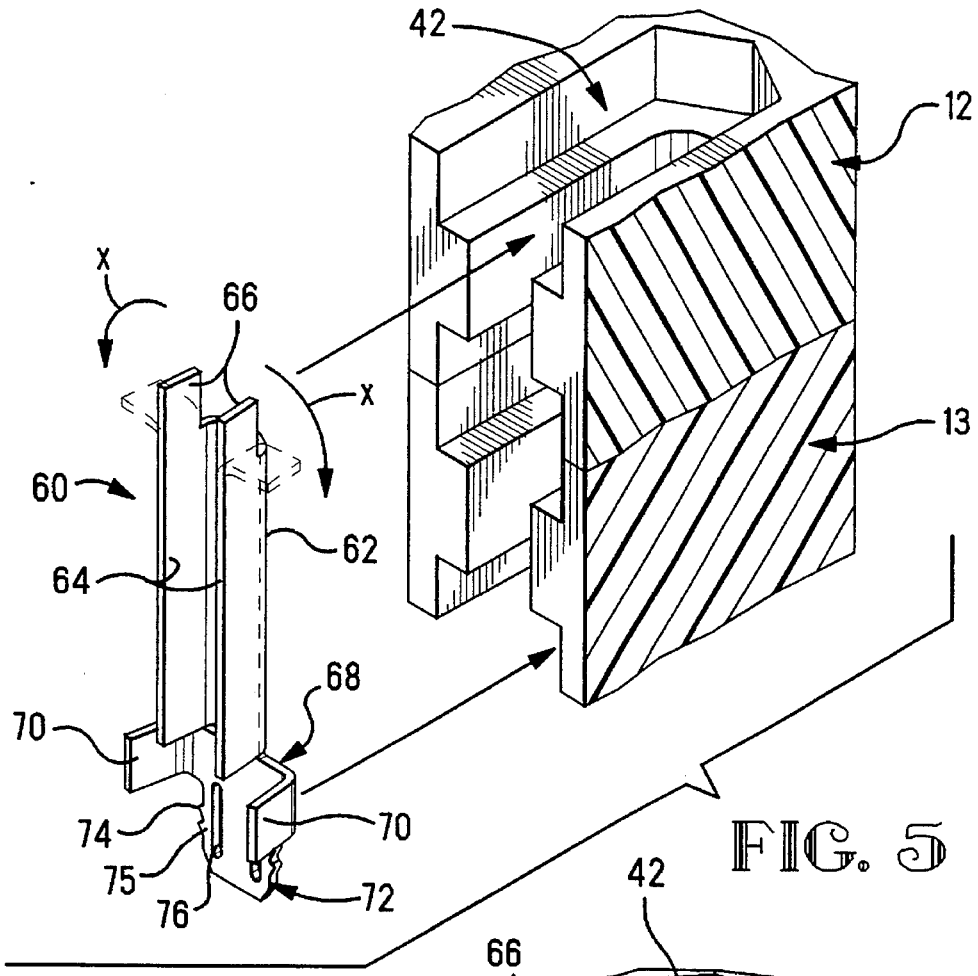
FIG. 5 is a part perspective view of the hold down recess and the mounting bracket exploded therefrom.
Figure 6:
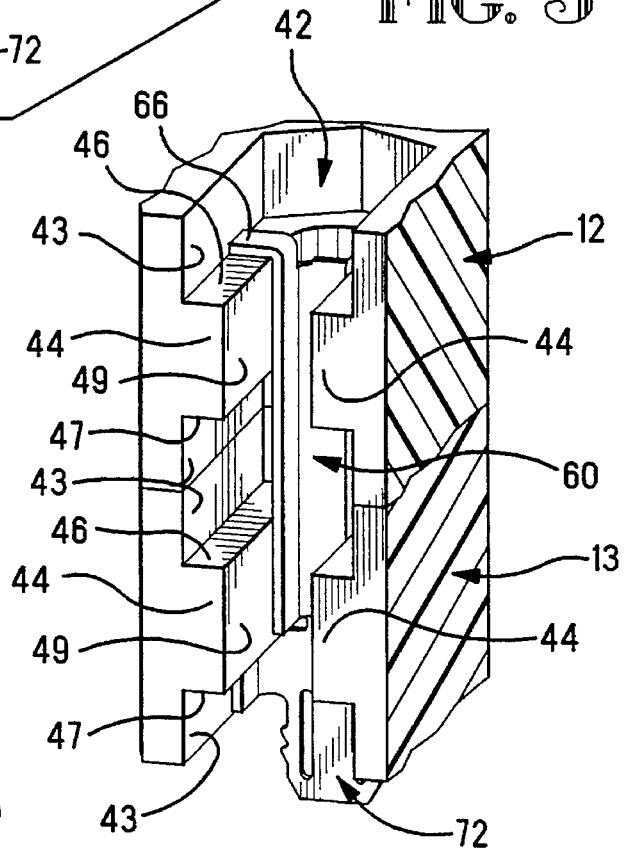
FIG. 6 is a view similar to FIG. 5 showing the mounting bracket in the recess.

The two connectors 12, 13 are secured together and mounted to the circuit board 15 by way of mounting brackets 60, as best shown in FIGS. 4–6, which can be installed in both hold down recesses 42. The mounting bracket 60 has a main body portion 62 with wings 64 extending from either side of the main body 62. The wings 64 are bent towards each other to a position in which the wings 64 are not quite parallel to each other. The wings 64 have tab sections 66 extending straight up from the wings 64. The bracket 60 has a lower body portion 68 which is wider than the main body portion 62. The lower body 68 has arms 70 extending from the lower body 68. The arms 70 are bent towards each other to a position in which the arms 70 are not quite parallel to each other.

The mounting bracket 60 further has a planar boardlock portion 72 to secure the connectors 12, 13 to the circuit board 15. The boardlock 72 has barbs 74 along each side. The boardlock 72 further has slots 76 which extend along on either side of the boardlock 72 thereby forming resilient legs 75 containing the barbs 74.

The mounting brackets 60 are moved into the hold down recesses 42, see FIG. 5. The main body portion 62 fits between the walls 49 of the protrusions 44 of both the upper and lower connector 12, 13. The height of the main body 62 is such that it fits between the lower shoulder 47 of the bottom connector 13 and the upper shoulder 46 of the top connector 12. The wings 64 are pushed into a frictional engagement with the walls 49 of the protrusions 44 when the bracket 60 is inserted in the recess 42. The compression of the wings 64 assists in securing the bracket in the hold down recess 42. The lower body portion 68 fits into the hold down recess 42 below the lower shoulder 47 of the bottom connector 13 along the walls 43 of the recess 42. The arms 70 are pushed into frictional engagement with the walls 43 of the recesses 42 when the bracket 60 is inserted thereinto. The compression of the arms 70 assists in securing the bracket in position in the recess 42. The tab sections 66 are then bent perpendicular to the wings 64, in the direction X, towards the walls 43 of the recess 42 such that they fit securely over the upper shoulder 46 of the top connector 12. The bracket 60 is thereby secured in the recess by the tab sections 66 on the upper shoulders 46 of the top connector 12 and the arms 70 below the lower shoulder 47 of the bottom connector 13. The connectors 12, 13 are thereby secured together.

The boardlock 72 extends below the lower connector 13 and can be inserted into the mounting hole 37 at the same time that the downwardly extending tail sections 30 of the contacts 26 are inserted into the holes 32 on the circuit board 15. The mounting bracket 60 secures the connectors 12, 13 to the circuit board for soldering of the contacts 26 to the circuit board 15.

Figure 7:
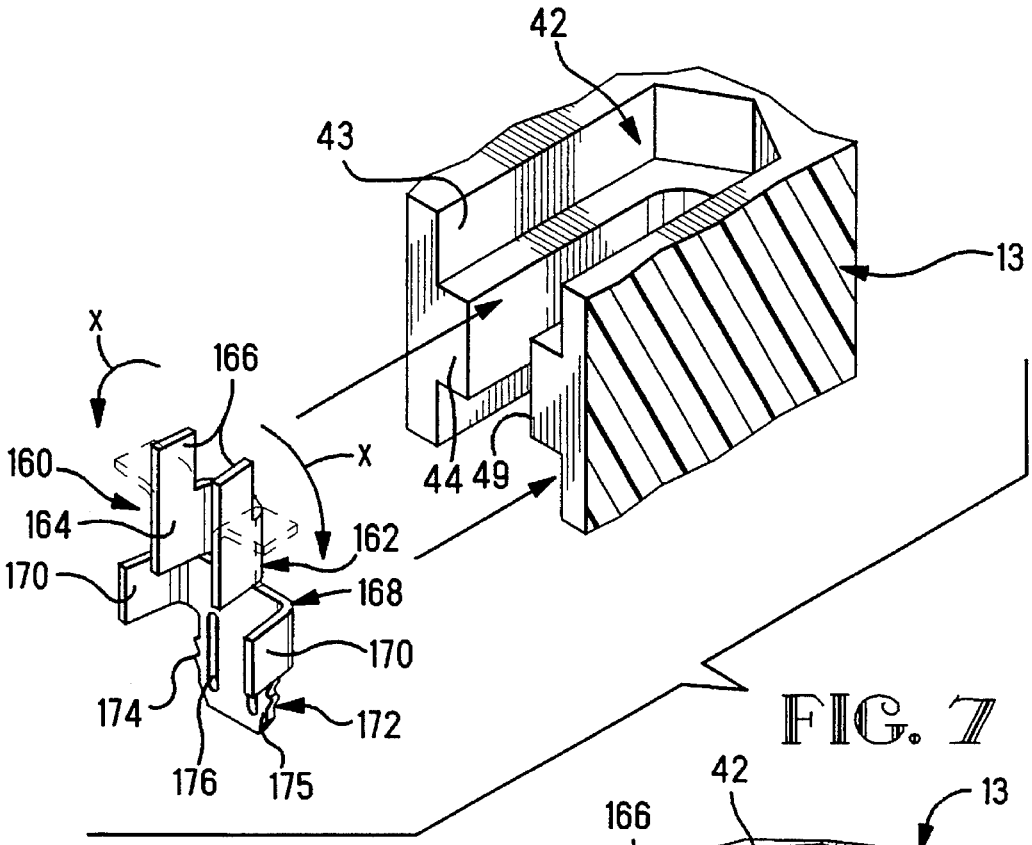
FIG. 7 is a part perspective view of an alternative embodiment of the present invention.
Figure 8:
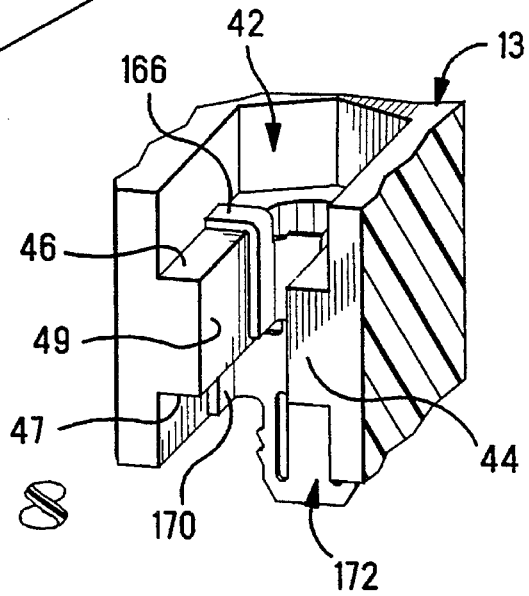
FIG. 8 is a part perspective view similar to FIG. 7 showing the mounting bracket in the recess.
Figure 9:
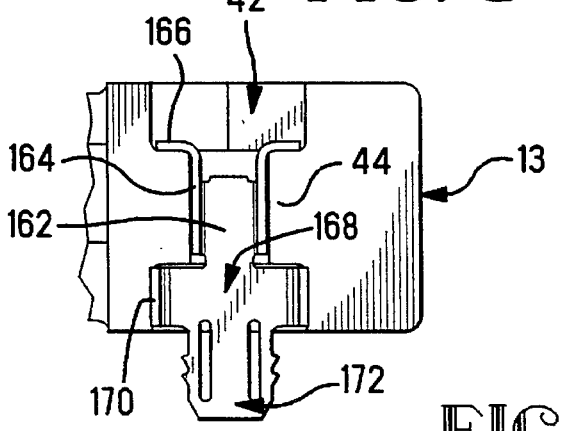
FIG. 9 is a rear view of the hold down recess with the mounting bracket therein of the alternative embodiment.

Another embodiment of the present invention is shown in FIGS. 7–9. A mounting bracket 160 can be used to secure a single card connector 13 to the circuit board 15. The mounting bracket 160 has a main body portion 162, wings 164 extending from the main body 162 which are bent towards each other but not quite parallel to each other, and tab sections 166 which extend straight up from the wings 164. The bracket 160 has a lower body portion 168, and arms 170 extending from the lower body portion 168 and which are bent towards each other but not quite parallel to each other. The bracket 160 also has a boardlock portion 172 which has barbs 174 and slots 176 forming resilient legs 175.

The main body 162 fits between the walls 49 of the protrusion 44 and the walls 49 compress the wings 164 when the bracket 162 is inserted into the recess 42. The height of the main body 162 is such that it fits between the upper shoulder 46 and the lower shoulder 47 of the one connector 13. The lower body portion 168 fits between the walls 43 of the recess 42 and is wider than the main body 162. The arms 170 are compressed when the bracket 160 is inserted into the recess 42. The compression of the wings 164 and the arms 170 assists in securing the bracket 160 in the recess 42. The tabs 166 are bent over, in the direction X, the upper shoulders 46 until the bracket is secured in the recess 42. The boardlock 172 extends below the connector 13 to be secured in a mounting hole 37 on the circuit board 15.

The mounting bracket of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A mounting bracket for securing an electrical connector to a circuit board where the connector has a hold down recess for receiving the bracket, the bracket comprising:

a main body portion, a lower body portion, and a boardlock portion, said main body portion having wings bent towards each other so as to be substantially parallel which are adapted to form a compression fit in the recess, said wings having bendable tabs extending upwardly therefrom for securing the bracket in the recess;

said lower body portion having arms bent towards each other which are adapted to form a compression fit within said recess; and said boardlock portion extending below the connector when the bracket is inserted in the hold down recess for securing said connector to the circuit board.

2. The bracket as in claim 1, wherein said main body portion has a height sufficient to secure two connectors together and to the circuit board.

3. The bracket as in claim 1, wherein said lower body portion is wider than said upper body portion, and said lower body portion and said bendable tab sections cooperate to secure the bracket in the recess.

4. The bracket as in claim 1, wherein said boardlock portion has barbs for engaging the circuit board.

5. The bracket as in claim 4, wherein said boardlock portion has slots which form resilient legs with said barbs thereon.

6. An electrical connector to be secured to a circuit board, comprising:

a housing having a hold down recess having a protrusion with opposing walls thereon;

a mounting bracket having a main body portion and a boardlock portion;

said main body portion having wings extending therefrom and bent towards each other so as to be substantially parallel, said main body portion having securing means on top of and on bottom of said main body portion for securing said bracket in said recess;

whereby said main body portion fits in between said opposing walls and said wings form a compression fit therewith, said securing means being seated in said recess and securing said bracket in the recess by extending above and below said protrusion, and said boardlock portion extends below said connector for securing in the circuit board.

7. The connector of claim 6, wherein said securing means on said bottom of said main body portion comprises a lower body portion with arms extending therefrom and bent towards each other, said arms form a compression fit between the walls of said recess, below said protrusion.

8. The connector of claim 7, wherein said securing means on said top of said main body portion comprises bendable tab sections which can be bent over the top of said protrusion to secure said bracket in said recess.

9. The connector of claim 8, wherein said connector includes two card connectors stacked on top of each other.

10. The connector of claim 9, wherein said bracket is secured in the recess by bending said tab sections to a top of the protrusion in the upper connector and the arms are below a bottom of the protrusion in the lower connector, and said main body portion has a height sufficient to extend between said top of the protrusion in the upper connector and said bottom of said protrusion in said lower connector.

11. The connector of claim 8, wherein said main body has a height less than the protrusion.

12. The connector of claim 6, wherein said boardlock portion has barbs for securing in a hole in the circuit board.

13. The connector of claim 12, wherein said boardlock portion has slots on each side forming resilient legs with said barbs on either side of said legs.

14. The connector of claim 8, wherein said lower body portion is wider than said main body portion.

* * * * *